US005992546A

United States Patent [19]

Heinrich et al.

[11] Patent Number: 5,992,546

[45] Date of Patent: Nov. 30, 1999

[54] ROTARY EARTH STRATA PENETRATING TOOL WITH A CERMET INSERT HAVING A CO-NI-FE-BINDER

[75] Inventors: Hans-Wilm Heinrich; Manfred Wolf; Dieter Schmidt, all of Bayreuth, Germany; Uwe Schleinkofer, Latrobe, Pa.

[73] Assignee: Kennametal Inc., Latrobe, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,979

[22] Filed: Aug. 27, 1997

[51] Int. Cl.[6] ..... E21B 10/00

[52] U.S. Cl. ..... 175/374; 175/420.1; 175/426; 428/698

[58] Field of Search ..... 175/374, 420.1, 175/414, 425, 426; 428/697, 698

[56] References Cited

U.S. PATENT DOCUMENTS

| | | | |
|---|---|---|---|
| Re. 30,807 | 12/1981 | Elders | 299/86 |
| Re. 34,180 | 2/1993 | Nemeth et al. | 428/547 |
| 2,162,574 | 6/1939 | Dawihl et al. | 75/136 |
| 2,202,821 | 6/1940 | Balke | 75/136 |
| 3,514,271 | 5/1970 | Yates | 29/182.5 |
| 3,816,081 | 6/1974 | Hale . | |
| 4,049,380 | 9/1977 | Yih et al. | 428/539.5 |
| 4,083,605 | 4/1978 | College et al. | 299/91 |
| 4,556,424 | 12/1985 | Viswanadham | 75/240 |
| 4,593,776 | 6/1986 | Salesky et al. | 175/375 |
| 4,642,003 | 2/1987 | Yoshimura | 408/144 |
| 4,743,515 | 5/1988 | Fisher et al. | 428/698 |
| 4,869,329 | 9/1989 | Kar et al. | 175/426 X |
| 4,907,665 | 3/1990 | Kar et al. | 175/426 |
| 4,971,485 | 11/1990 | Nomura et al. | 408/144 |
| 5,066,553 | 11/1991 | Yoshimura et al. | 428/698 |
| 5,186,739 | 2/1993 | Isobe et al. | 75/238 |
| 5,541,006 | 7/1996 | Conley | 428/552 |
| 5,658,395 | 8/1997 | Wahlberg et al. | 148/237 |
| 5,697,042 | 12/1997 | Massa et al. | 419/10 |
| 5,716,170 | 2/1998 | Kammermeier et al. | 408/145 |
| 5,766,742 | 6/1998 | Nakamura et al. | 428/210 |
| 5,776,588 | 7/1998 | Moriguchi et al. | 428/210 |
| 5,776,593 | 7/1998 | Massa et al. | 428/212 |
| 5,806,934 | 9/1998 | Massa et al. | 299/111 |
| 5,821,441 | 10/1998 | Kawamura | 75/248 |

FOREIGN PATENT DOCUMENTS

| | | |
|---|---|---|
| 1543214 | 10/1968 | France . |
| 29617040 | 3/1997 | Germany . |
| 46-15204 | 4/1971 | Japan . |
| 50-110909 | 9/1975 | Japan . |
| 53-21016 | 2/1978 | Japan . |
| 5429900 | 3/1979 | Japan . |
| 61194147 | 8/1986 | Japan . |
| 2273301 | 6/1994 | United Kingdom . |
| WO9621052 | 7/1996 | WIPO . |
| 97218444A | 6/1997 | WIPO . |

OTHER PUBLICATIONS

L. J. Prakash et al.: "The influence of the Binder Composition on the Properties of WC–Fe/Co/Ni Cemented Carbides," Mod. Dev. Powder Metal, vol. 14, 1981, XP002085832.

Chemical Abstracts, vol. 121, No. 22, Nov. 1994, Abstract No. 261210. (J.M. Guilemany et al.: "Mechanical–Property Relationships of Co/WC and Co–Ni–Fe/WC Hard Metal Alloys," Int. J. Refractory Metals & Hard Materials, (1994), 12(4), 199–206).

B. Uhrenius et al.: "On the Composition of Fe–Ni–Co–WC–based Cemented Carbides," vol. 15, 1997, pp. 139–149, XP002085833.

H. Grewe et al.: "Substitution of Cobalt in Cemented Carbides," Metall (Berlin) (1986), 40(2), 133–40, XP002086162.

Chemical Abstracts, vol. 126, No. 9, Mar. 1997, Abstract No. 121055. (Yoshihiro Minato et al.: "Tungsten Carbide–Based Hard Alloys Having High Impact Resistance for Tools,"JP 08 302441 A (Sumitomo Electric Industries, Japan)).

Chemical Abstracts, vol. 114, No. 6, Feb. 1991, Abstract No. 47911. (Noribumi Kikichi et al.: "Manufacture of Surface–Coated Tungsten Carbide–Based Cermets for Cutting Tools," JP02 022454 (Mitsubishi Metal Corp., Japan)).

Chemical Abstracts, vol. 108, No. 12, Mar. 1988, Abstract No. 99568. (Sokichi Taktau et al.: "Alumina–Coated (Mitsubishi Metal Corp., Japan) Sintered Alloys for Cutting Tools," JP 62 047123 (Toshiba Tungaloy Co., LTD, Japan)).

Copies of International Search Reports mailed Dec. 14, 1998, in Application Nos. PCT/IB98/01297, PCT/IB98/01298, PCT/IB98/01299, PCT/IB98/01300, and PCT/IB98/01301, all Filed Aug. 20, 1998.

PTO 99–2840; H. Grewe et al.—English Translation of "Cobalt Replacement in Technical Hard Metals", Tranlsation Apr. 1999.

Thakur, Dr. Babu N., "The Role of Metal Powders in Manufacturing Diamond Tools," SME Technical Paper, MR85–307, Superabrasives '85 Conference, Apr. 22–25, 1985, Chicago, pp. Title Page–17.

Kennametal Inc., Latrobe, PA, "Hot–Press Diamond Matrix Powders," Publication No. ML86–1(2.5)C6, 1986, pp. Title Page–31.

Kennametal Inc., Latrobe, PA, "Infiltration Diamond Matrix Powders," Publication No. ML86–4(3)G6, 1986, Title Page–27.

Macro Division of Kennametal Inc., Port Coquitlam, B.C., Canada, "Cobamet Alloy Powders," Publication No. CT6086–2, 1986, one page.

Macro Division of Kennametal Inc., Port Coquitlam, B.C., Canada, "Cobamet Alloys," Publication No. AM89–10, 1989, one page.

Table I, entitled "COBAMET Alloy Powder," one page.

Farooq, T. et al., "73 A Study on Alternative Matrices for WC Hardmetals," PM 1990's, Int. Conf. Powder Metall. (1990), Issue 2, 388–94, Inst. Met., London, U.K., pp. 388–394.

Holleck, H., et al., 1977 Annual Report, Aufbau, Herstellung, und Eigenschaften hochschmelzender Verbindungen and Systeme (Harstoffe und Harmetalle), KfK–Ext. 6/78–1, Institute for Materials and Solid State Research, Kernforschungszentrum in Karlsruhe, Germany, pp. 1–140 (pp. 87–94 English).

"Binary Alloy Phase Diagrams," Second Edition, vol. 2.0 ed., Ed. Massalski, T. B. et al, pp. 971, 1047–1050 & 1179–1265, ASM International.

Guillermet, A. F., "The Co–Fe–Ni–W–C Phase Diagram: A Thermodynamic Description and Calculated Sections for (Co–Fe–Ni) Bonded Cemented WC Tools," Z. Metallkd. (1989), 80(2), pp. 83–94.

Crook, P., "Cobalt and Cobalt Alloys," Metals Handbook, Tenth Edition, vol. 2 Properties and Selection: Nonferrous Alloys and Special–Purpose Materials (1990), pp. 446–454, ASM International.

Betteridge, W., "Cobalt and Its Alloys," Ellis Horwood Ltd., Halsted Press: a division of John Wiley & Sons, New York, 1982, pp. 41–59.

"Cobalt Facts," Section 10, Cobalt Supply & Demand 1995, pp. 105–112, The Cobalt Development Institute, Essex, U.K.

"Cobalt Monograph," 1960, pp. 170–240. Ed. Centre D'Information du Cobalt, Brussels, Belgium.

Holleck, H. et al., "Constitution of Cemented Carbide Systems," Int. J. Refract. Hard Met. 1, (3), pp. 112–116 (Sep. 1982).

Brabyn, S. M. et al., "Effects of the Substitution of Nickel for Cobalt in WC Based Hardmetal," Proceedings of the $10^{th}$ Plansee—Seminar 1981 (Metalwork Plansee, Reutte, Austria, Jun. 1–5, 1981) vol. 2, pp. 675–692, Ed. H. M. Ortner.

Schleinkofer, U., et al., "Fatigue of Cutting Tool Materials," Proceedings of the Sixth International Fatigue Congress, 1996, Berlin, Germany, pp. 1639–1644, "Fatigue '96,'" vol. III, Ed. Lütjering & Nowack.

Schleinkofer, U. et al., "Fatigue of Hard Metals and Cermets," Materials Science and Engineering A209 (1996), pp. 313–317.

Schleinkofer, U. et al., "Microstructural Processes During Subcritical Crack Growth in Hard Metals and Cermets under Cyclic Loads," Materials Science and Engineering A209 (1996), pp. 103–110.

Schleinkofer, U., "Fatigue of Hard Metals and Cermets Under Cyclically Varying Stress," (German Language and English Translation), Thesis submitted to the Technical Faculty of the University of Erlangen–Nürnberg, 1995, pp. 11–12, 96–100, 199–203, & 207.

Schleinkofer, U. et al., "Fatigue of Hard Metals and Cermets—New Results and a Better Understanding," Int'l. J. of Refractory Metals & Hard Materials 15 (1997), pp. 103–112.

Schleinkofer, U. et al., "Fatigue of Hard Metals and Cermets—The Present Knowledge and its Technical Importance and Application," Proceedings of the 1996 World Congress on Powder Metallurgy & Particular Materials, pp. 18–85 to 18–96, reprinted from Advances in Powder Metallurgy & Particulate Materials—1996.

Brookes, K. J. A., "World Directory and Handbook of Hardmetals and Hard Materials," Sixth Edition, International Carbide Data, pp. D15, D19, D31, D38, D44, D63, D78, D79, D82, D87, D96, D143, D175, D182, D223, D234, D237A.

Moskowitz, D. et al., "High–Strength Tungsten Carbides," International Journal of Powder Metallurgy 6 (4) 1970, pp. 55–64.

Prakash, L. J., "The Influence of Carbide Grain Size and Binder Composition on the Properties of Cemented Carbides," Horizons in Powder Metallurgy (Proc. Of the 1986 International PM Conf. And Exhibition, Dusseldorf, Jul. 7–11, 1986) Part 1, pp. 261–264 (1986).

Prakash, L. et al., "The Influence of the Binder Composition on the Properties of WC–Fe/Co/Ni Cemented Carbides," Mod. Dev. Powder Metall. (1981), 14, pp. 255–268.

Roebuck, B., "Magnetic Moment (Saturation) Measurements on Hardmetals," National Physical Laboratory, Dec. 1994, DMM(A)146, pp. 1–12.

Guilemany, J. M., et al., "Mechanical–Property Relationships of Co/WC and Co–Ni–Fe/WC Hard Metal Alloys," International Journal of Refractory Metals and Hard Materials 12 (1993–1994), pp. 199–206.

Gabriel, A., et al., "New Experimental Data in the C–Fe–W, –Co–W, C–Ni–W, C–Fe–Ni–W and C–Co–Ni–W Systems Application to Sintering Conditions of Cemented Carbides Optimization of Steel Binder Composition by Partial Factorial Experiments," Int. Inst. of the Science of Sintering Conf. held at Herceg–Novi, Yugoslavia (Sep. 1985), pp. 379–393, published by Plenum Press.

Gabriel, A. et al., "New Experimental Data in the C–Co–W, C–Fe–W, C–Ni–W C–Fe/Ni–W and C–Co/Ni–W Systems and Their Applications to Sintering Conditions," $11^{th}$ International Plansee Seminar '85, (May 20–24, 1985, Reutte, Tirol, Austria), vol. 2, pp. 509–525, Ed. H. Bildstein & H. M. Ortner.

Mankins, W. L., et al., "Nickel and Nickel Alloys," Metals Handbook, Tenth Edition, vol. 2, Properties and Selection: Nonferrous Alloys and Special–Purpose Materials (1990), pp. 428–445, ASM International.

Uhrenius, B., et al., "On the Composition of Fe–Ni–Co–Wc–Based Cemented Carbides," International Journal Of Refractory Metals And Hard Materials 15 (1997), pp. 139–149.

Schubert, W–D., et al., "Phase Equilibria in the Systems Co–Mo–W–C and Ni–Mo–W–C," Translated from German, High Temperatures–High Pressures, 1982, Vo. 14, pp. 87–100.

Raynor, G. V., et al., "Phase Equilibria in Iron Ternary Alloys, A Critical Assessment of the Experimental Literature," The Institute of Metals, 1988, pp. 7, 15, 16, 27–34, 71–80, 140–142, and 213–288.

Prakash, L., "Properties of Tungsten Carbides with an Iron–Cobalt–Nickel Binder in Sintered and Heat–Treated States" (German Language and English Translation), KFK–Nachr. (1979), 11(2), pp. 35–42, Inst. Mater.–Festkoerperforsch., Karlsruhe, Germany.

Sundman B., et al., "The Thermo–Calc Databank System," Calphad, vol. 9, No. 2, 1985, pp. 153–190.

Doi, A. et al., "Thermodynamic Evaluation of Equilibrium Nitrogen Pressure and WC Separation in Ti–W–C–N System Carbonitride," 11$^{th}$ International Plansee Seminar '85 (May 20–24, 1985, Reutte, Tirol, Austria), vol. 1, pp. 825–843, Ed. H. Bildstein & H. M. Ortner.

Gustafson, P., "Thermodynamic Evaluation of C–W System," Materials Science and Technology, Jul., 1986, vol. 2, pp. 653–658.

Prakash, L. J., "Weiterentwicklung von Wolframcarbid Hartmetallen unter Verwendung von Eisen–Basis–Bindelegierungen [Development of Tungsten Carbide Hardmetals Using Iron–Based Binder Alloys]," KfK 2984, Institute of Materials and Solid States Research by Kernforschungszentrum in Karlsruhe, Germany, 1980, pp. 1–221 (German Language).

Ramqvist, L., "Wetting of Metallic Carbides by Liquid Copper, Nickel, Cobalt and Iron," International Journal of Powder Metallurgy 1 (4), 1965, pp. 2–21.

Warren, R., "The Wetting of the Mixed Carbide, 50 w/o WC/50 w/o TiC by Cobalt, Nickel and Iron and Some of Their Alloys," International Journal of Powder Metallurgy 4 (1), 1968, pp. 51–60.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722.

Zhang Li, et al, "A New Hardmetal for Mining with Ni–Co Binder," Int. J. of Refractory Metals & Hard Materials 14 (1996), pp. 245–248.

Holleck, H., et al., 1977 Annual Report, Aufbau, Herstellung, und Eigenschaften hochschmelzender Verbindungen and Systeme (Harstoffe und Harmetalle), KfK–Ext. 6/78–1, Institute for Materials and Solid State Research, Kernforschungszentrum in Karlsruhe, Germany, pp. 57–65 including English translation of Oberacker, R., et al., "Properties of Tungsten Carbide Hard Metals with Fe–Co–Ni Binder Alloys, Part I: Effect of the Composition, including Carbon Content," pp. 57–65.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 66–77 including English translation of Prakash, L., "Properties of Tungsten Carbide Hard Metals with Fe–Co–Ni Binder Alloys, Part II: Effect of Heat Treatment," pp. 66–77.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 78–86 including English translation of Oberacker, R., et al., "Wettability of Tungsten Carbide By Fe–Co–Ni Binder Alloys," pp. 78–86.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722. (English Translation).

Raynor, G. V., et al., "Phase Equilibria in Iron Ternary Alloys, A Critical Assessment of the Experimental Literature," The Institute of Metals, 1988, pp. 247–255.

"Binary Alloy Phase Diagrams," Second Edition, vol. 1.0 ed., Ed. Massalski, T. B. et al, pp. 136–138, 269–270, 355–356, 471–472, 571, 725–727, 835–836, 902–905.

Roebuck, B., et al., "Miniaturised thermomechanical tests on hardmetals and cerments" in ed., Sarin, V., "Science of Hard Materials—5," Proceedings of the 5$^{th}$ International Conference on the Science of Hard Materials, Maui, Hawaii, Feb. 20–24, 1995, Materials Science and Engineering, Elsevier Publishing Company, vol. A209, Nos. 1–2, pp. 358–365.

Suzuki, H., et al, "Effects of Surface–Grinding on Mechanical Properties of WC–Co Alloy", Journal of the Japan Institute of Metals (1974), vol. 38, No. 7, pp. 604–608 (Japanese Language with some English Translation).

Suzuki, H., et al, "Room–Temperature Transverse–Rupture Strength of WC–10% Ni Cemented Carbide", J. Japan Inst. Met. 41 (6), Jun. 1977, pp. 559–563(Japanese Language with some English Translation).

Suzuki, H., et al, Properties of WC–10% (Ni–Fe) Alloys, Department of Metallurgy, Faculty of Engineering, University of Tokyo, Tokyo, pp. 26–31 (Japanese Language with some English Translation).

"Standard Test Method for Flexural Strength of Advanced Ceramics at Ambient Temperature," (Designation: C 1161–90) reprinted from Annual Book of ASTM Standards, American Society for Testing and Materials, Philadelphia, PA.

Prakash, L., et al, "Properties of Tungsten Carbides with Iron–Cobalt–Nickel Alloys as Binders," Sixth International Powder Metallurgy Conference, Dresden, German Democratic Republic, 1977, pp. 39–1–39–16, preprint (German and English Translation).

Thümmler, F., et al, "Ergebnisse Zur Weiterentwicklung Von Hartstoffen Und Hartmetallen," (German Language), Proc. Plansee–Semin., 10th (1981), vol. 1, pp. 459–476, Metallwork Plansee GmbH, Reutte, Austria.(English Translation).

Penrice, T., "Alternative Binders for Hard Metals," J. Materials Shaping Technology, vol. 5, No. 1, 1987, pp. 35–39, 1987 Springer–Verlag New York Inc.

*Primary Examiner*—Roger Schoeppel
*Attorney, Agent, or Firm*—John J. Prizzi

[57] ABSTRACT

A rotary tool that includes an elongate tool body and a hard insert affixed to the tool body is disclosed. The hard insert includes a WC-cermet including tungsten carbide and about 5 wt. % to 19 wt. % Co—Ni—Fe-binder. The Co—Ni—Fe-binder is unique in that even when subjected to plastic deformation, the binder substantially maintains its face centered cubic (fcc) crystal structure and avoids stress and/or strain induced transformations.

21 Claims, 1 Drawing Sheet

ROTARY EARTH STRATA PENETRATING TOOL WITH A CERMET INSERT HAVING A CO-NI-FE-BINDER

BACKGROUND

The present invention pertains to a rotary tool for penetrating the earth strata such as, for example, a roof drill bit or a tri-cone drill bit, that has one or more hard inserts at the axially forward end. In the case of a roof drill bit, such a rotary tool has been typically used to drill holes in a mine roof. In the case of a tri-cone drill bit, such a rotary tool has been used to drill holes for oil wells and the like.

The typical rotary tool has a hard insert affixed at an axially forward end. The hard insert is the part of the rotary tool that first impinges upon the earth strata or other substrate. The hard insert is comprised of a tungsten carbide cermet (WC-cermet), also known as cobalt cemented tungsten carbide and WC-Co. Here, a cobalt binder (Co-binder) cements tungsten carbide particles together. Although hard inserts made of a WC-cermet having a Co-binder have achieved successful results, there are some drawbacks.

One drawback is that up to about 45 percent of the world's primary cobalt production is located in politically unstable regions (e.g., political regions that have experienced either armed or peaceful revolutions in the past decade and could still experience additional revolutions). About 15 percent of the world's annual primary cobalt market is used in the manufacture of hard materials including WC-cermets. About 26 percent of the world's annual primary cobalt market is used in the manufacture of superalloys developed for advanced aircraft turbine engines—a factor contributing to cobalt being designated a strategic material. These factors not only contribute to the high cost of cobalt but also explain cobalt's erratic cost fluctuations. Consequently, cobalt has been relatively expensive, which, in turn, has raised the cost of the WC-cermet hard insert, as well as the cost of the overall rotary tool. Such an increase in the cost of the rotary tool has been an undesirable consequence of the use of Co-binder for the hard insert. Therefore, it would be desirable to reduce cobalt from the binder of WC-cermet hard inserts.

Furthermore, because of the principal locations of the largest cobalt reserves, there remains the potential that the supply of cobalt could be interrupted due to any one of a number of causes. The unavailability of cobalt would, of course, be an undesirable occurrence.

Rotary tools operate in environments that are corrosive. While the WC-cermet hard inserts have been adequate in such environments, there remains the objective to develop a hard insert which has improved corrosion resistance while maintaining essentially the same wear characteristics of WC-cermet hard inserts.

While the use of WC-cermet hard inserts has been successful, there remains a need to provide a hard insert which does not have the drawbacks, i.e., cost and the potential for unavailability, inherent with the use of cobalt set forth above. There also remains a need to develop a hard insert for use in corrosive environments that possess improved corrosion resistance without losing any of the wear characteristics of WC-cermets having a Co-binder.

SUMMARY

In one embodiment, the invention is rotary tool comprising an elongate tool body that has an axially forward end and an axially rearward end. A hard insert is affixed to the rotary tool body at the axially forward end. The composition of the hard insert comprises about 5 weight percent (wt. %) to about 19 wt. % percent binder, and about 81 wt. % to 95 wt. % tungsten carbide. The binder comprises a cobalt-nickel-iron-binder (Co—Ni—Fe-binder).

In another embodiment, the invention is a hard insert for use in a rotary tool having an elongate tool body with an axially forward end, wherein the hard insert is affixed to the tool body at the axially forward end. The composition of the hard insert comprises about 5 wt. % to 19 wt. % binder, and about 81 wt. % to 95 wt. % tungsten carbide. The binder comprises a Co—Ni—Fe-binder.

In still another embodiment, the invention is a rotatable cutting tool comprising an elongate tool body that has an axially forward end with a hard insert affixed to the tool body at the axially forward end. The composition of the hard insert comprises about 5 wt. % to 19 wt. % binder. The binder comprises at least about 40 wt. % cobalt but not more than about 90 wt. % cobalt, at least about 4 wt. % nickel, and at least about 4 wt. % iron. The tungsten carbide has a grain size comprising about 1 micrometer ($\mu$m) to about 30 $\mu$m.

The invention illustratively disclosed herein may suitably be practiced in the absence of any element, step, component, or ingredient that is not specifically disclosed herein.

BRIEF DESCRIPTION OF THE DRAWINGS

These and other features, aspects, and advantages of the present invention will become better understood with reference to the following description, appended claims, and accompanying drawings where:

DESCRIPTION

Figure 1:
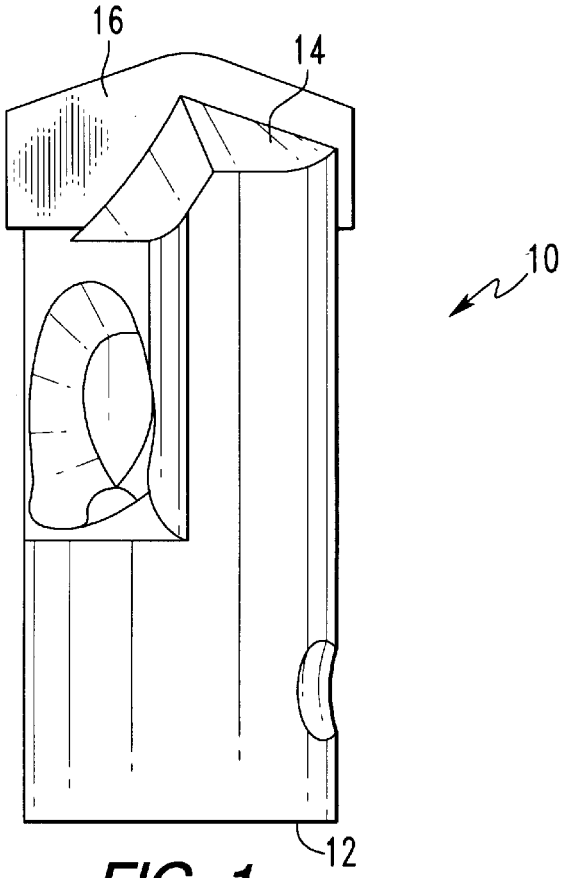
FIG. 1 is a is a side view of a roof drill bit of the style KCV4-1RR (Roof Rocket) made by Kennametal Inc. of Latrobe, Pa.

Referring to FIG. 1, there is illustrated a roof drill bit, generally designated as 10, of the style KCV4-1RR (Roof Rocket) made and sold by Kennametal Inc. of Latrobe, Pa. 15650 (the assignee of the present patent application). Roof drill bit 10 has an elongate body with an axially rearward end 12 and an axially forward end 14. A hard insert 16 is affixed to the elongate body 12 at the axially forward end 14 thereof. In addition to the style illustrated in FIG. 1, applicants contemplate that the roof drill bits which may use cutting inserts of the compositions set forth herein include the roof drill bit shown and described in pending United States Patent Application Serial No. [unknown at this time] filed on Jul. 15, 1997 for a ROTATABLE CUTTING BIT ASSEMBLY WITH WEDGE-LOCK RETENTION ASSEMBLY by Ted R. Massa, Robert H. Montgomery, William P. Losch, and David R. Siddle, and assigned to Kennametal Inc. of Latrobe, Pa., and the roof drill bit shown and described in pending United States Patent Application Serial No. [unknown at this time] filed on Jul. 15, 1997 for a ROTATABLE CUTTING BIT ASSEMBLY WITH CUTTING INSERTS by Ted R. Massa and David R. Siddle, and assigned to Kennametal Inc. of Latrobe, Pa. Both of the above-mentioned pending patent applications filed on Jul. 15, 1997 are hereby incorporated by reference herein.

Referring to the hard insert 16 of the roof drill bit 10, the composition of the hard insert 16 comprises a Co—Ni—Fe-binder and tungsten carbide (WC). The range of the Co—Ni—Fe-binder in the WC-cermet comprises about 5 wt. % to 19 wt. %.

Figure 2:
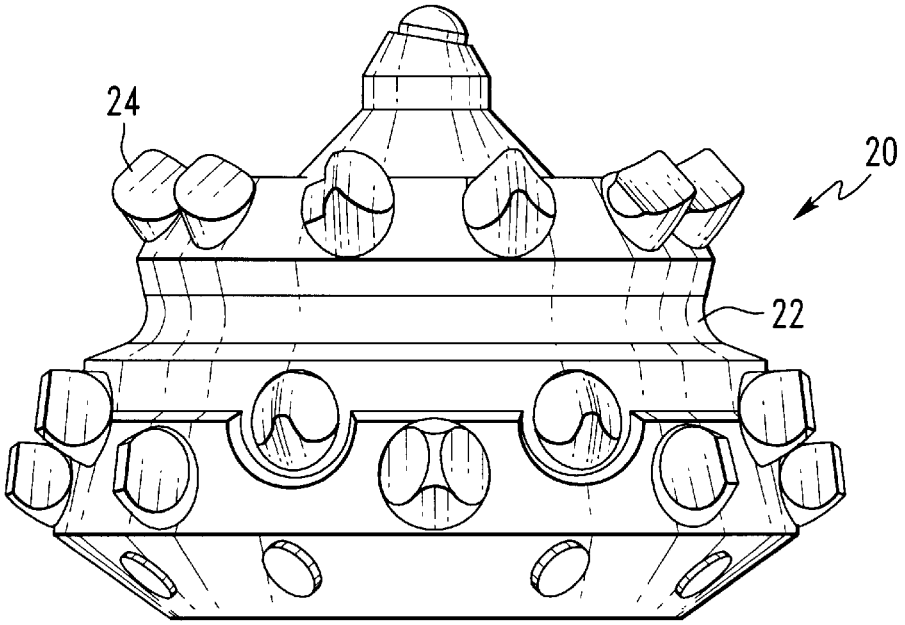
FIG. 2 is a side view of a drill bit used for downhole drilling.

Referring to FIG. 2, there is illustrated a drill bit, generally designated as 20, for downhole drilling such as is shown in U.S. Pat. No. 4,108,260, for a ROCK BIT WITH SPECIALLY SHAPED INSERTS, to Bozarth. Drill bit 20 has a drill bit body 22 which receives a plurality of hard inserts 24, which are made from the same WC-current having a Co—Ni—Fe-binder from which hard insert 16 is made. Thus, a description of a WC-cermet in conjunction with hard insert 16 will suffice for the description of the WC-cermet for hard insert 24.

In this regard, the composition of WC-cermet having a Co—Ni—Fe-binder from which the hard insert 16 for the roof drill bit 10 or the hard insert 50 for the tri-cone drill bit 40 comprises a Co—Ni—Fe-binder and tungsten carbide. The Co—Ni—Fe-binder comprises at least about 40 wt. % cobalt but not more than about 90 wt. % cobalt, at least about 4 wt. % nickel, and at least about 4 wt. % iron. Applicants believe that a Co—Ni—Fe-binder comprising not more than about 36 wt. % Ni and not more than about 36 wt. % Fe is preferred. A preferred Co—Ni—Fe-binder comprises about 40 wt. % to 90 wt. % Co, about 4 wt. % to 36 wt. % Ni, about 4 wt. % to 36 wt. % Fe, and a Ni:Fe ratio from about 1.5:1 to 1:1.5. A more preferred Co—Ni—Fe-binder comprises about 40 wt. % to 90 wt. % Co and a Ni:Fe ratio of about 1:1. An even more preferred Co—Ni—Fe-binder alloy comprises a cobalt:nickel:iron ratio of about 1.8:1:1.

The Co—Ni—Fe-binder of the present invention is unique in that even when subjected to plastic deformation, the binder maintains its face centered cubic (fcc) crystal structure and avoids stress and/or strain induced transformations. Applicants have measured strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels that leads to superior performance.

It will be appreciated by those skilled in the art that the Co—Ni—Fe-binder may also comprise at least one secondary alloying element either in place of one or both of nickel and iron and/or in a solid solution with the Co—Ni—Fe-binder and/or as discrete precipitates in the Co—Ni—Fe-binder. Such at least one secondary alloying element may contribute the physical and/or mechanical properties of the WC-cermet. Whether or not the at least one secondary alloying element contributes to the properties of the WC-cermet, the least one secondary alloying element may be included in the Co—Ni—Fe-binder to the extent that the least one secondary alloying element does not detract from the properties and/or performance of the WC-cermet.

The preferred range of Co—Ni—Fe-binder in the WC-cermet comprises about 5 wt. % to 19 wt. %. A more preferred range of the Co—Ni—Fe-binder in the WC-cermet comprises about 5 wt. % to 15 wt. %. An even more preferred range of Co—Ni—Fe-binder in the WC-cermet comprises about 5 wt. % to 10 wt. %.

The grain size of the tungsten carbide (WC) hard component comprises a broadest range of about 1 micrometers ($\mu$m) to 30 $\mu$m. A mediate range for the grain size of the WC comprise about 1 $\mu$m to 15 $\mu$m.

Applicants contemplate that every increment between the endpoints of ranges disclosed herein, for example, binder content, binder composition, Ni:Fe ratio, hard component grain size, hard component content, . . . etc. is encompassed herein as if it were specifically stated. For example, a binder content range of about 5 wt. % to 19 wt. % encompasses about 1 wt. % increments thereby specifically including about 5 wt. %, 6 wt. %, 7 wt. %, . . . 17 wt. %, 18 wt. % and 19 wt. % binder. While for example, for a binder composition the cobalt content range of about 40 wt. % to 90 wt. % encompasses about 1 wt. % increments thereby specifically including 40 wt. %, 41 wt. %, 42 wt. %, . . . 88 wt. %, 89 wt. %, and 90 wt. % while the nickel and iron content ranges of about 4 wt. % to 36 wt. % each encompass about 1 wt. % increments thereby specifically including 4 wt. %, 5 wt. %, 6 wt. %, . . . 34 wt. %, 35 wt. %, and 36 wt. %. Further for example, a Ni:Fe ratio range of about 1.5:1 to 1:1.5 encompasses about 0.1 increments thereby specifically including 1.5:1, 1.4:1, . . . 1:1, . . . 1:1.4, and 1:1.5). Furthermore for example, a hard component grain size range of about 1 $\mu$m to about 30 $\mu$m encompasses about 1 $\mu$m increments thereby specifically including about 1 $\mu$m, 2 $\mu$m, 3 $\mu$m, . . . 28 $\mu$m, 29 $\mu$m, and 30 $\mu$m.

The present invention is illustrated by the following. It is provided to demonstrate and clarify various aspects of the present invention: however, the following should not be construed as limiting the scope of the claimed invention.

As summarized in Table 1, a WC-cermet having a Co—Ni—Fe-binder of this invention and a comparative conventional WC-cermet having a Co-binder were produced using conventional powder technology as described in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel AG, Werkzeuge+Hartstoffe, Fuerth, Bavaria, Germany (1993); and "CEMENTED CARBIDES", by P. Schwarzkopf & R. Kieffer, The Macmillan Company (1960)—the subject matter of which is herein incorporated by reference in it entirety. In particular, Table 1 presents a summary of the nominal binder content in weight percent (wt. %), the nominal binder composition, and the hard component composition and amount (wt. %) for a WC-cermet of this invention and a comparative prior art WC-cermet having a Co-binder. That is, commercially available ingredients (as described in, for example, "World Directory and Handbook of HARDMETALS AND HARD MATERIALS" Sixth Edition) that had been obtained for each of the inventive and the conventional composition as described in Table 1 were combined in independent attritor mills with hexane for homogeneous blending over a period of about 4.5 hours. After each homogeneously blended mixture of ingredients was appropriately dried, green bodies having the form of a plate for properties evaluation were pressed. The green bodies were densified by vacuum sintering a about 1570° C. for about one hour.

TABLE 1

Nominal Composition for Invention and Compactive Conventional WC-Cermet

| Sample | Nominal Binder Content (wt. %) | Nominal Binder Composition (wt. %) Co | Ni | Fe | Hard Component WC* |
|---|---|---|---|---|---|
| Invention | 9.5 | 4.5 | 2.5 | 2.5 | Remainder |
| Conventional | 9.5 | 9.5 | — | — | Remainder |

TABLE 1-continued

| Nominal Composition for Invention and Compactive Conventional WC-Cermet | | | | | |
|---|---|---|---|---|---|
| | Nominal Binder Content | Nominal Binder Composition (wt. %) | | | Hard Component |
| Sample | (wt. %) | Co | Ni | Fe | WC* |

*starting powder −80 + 400 mesh (particle size between about 38 μm and 180 μm) macrocrystalline tungsten carbide from Kennametal Inc. Fallon, Nevada As summarized in Table 2, the density (g/cm$^3$), the magnetic saturation (0.1 μTm$^3$/kg), the coercive force (Oe, measured substantially according to International Standard ISO 3326: Hardmetals—Determination of (the magnetization) coercivity), the hardness ($Hv_{30}$, measured substantially according to International Standard ISO 3878: Hardmetals—Vickers hardness test), the transverse rupture strength (MPa, measured substantially according to International Standard ISO 3327/Type B: Hardmetals—Determination of transverse rupture strength) and the porosity (measured substantially according to International Standard ISO 4505: Hardmetals—Metallographic determination of porosity and uncombined carbon) of the inventive and the conventional WC-cermets were determined. The WC-cermet having a Co—Ni—Fe-binder had a comparable hardness but an improved transverse rupture strength compared to the conventional WC-cermet having a Co-binder.

TABLE 2

| Mechanical and Physical Properties for Invention and Compactive Conventional WC-Cermet of Table 1 | | | | | | |
|---|---|---|---|---|---|---|
| Sample | Density (g/cm$^3$) | Magnetic Saturation 0.1 μTm$^3$/kg | Hc (Oe) | Hardness (HV30) | TRS (MPa) | Porosity |
| Invention | 14.35 | 178 | 18 | 970 | 2288 | A04 |
| Conventional | 14.44 | 173 | 54 | 960 | 1899 | A06 |

It can thus been seen that applicants' invention provides for a rotary tool, as well as the hard insert for the rotary tool, which overcomes certain drawbacks inherent in the use of a Co-binder in the hard insert. More specifically, the use of a Co—Ni—Fe-binder instead of a Co-binder alloy in the hard insert reduces the cost of the hard insert and the overall rotary tool. The use of a Co—Ni—Fe-binder instead of a Co-binder in the hard insert reduces the potential that the principal component, i.e., cobalt, for the binder will be unavailable due to political instability in those countries which possess significant cobalt reserves. It also becomes apparent that applicants' invention provides a rotary tool, and a hard insert therefor, which possess improved corrosion resistance without sacrificing wear properties equivalent to those of a WC-cermet hard insert having a Co-binder.

The patents and other documents identified herein, including United States patent application entitled, "A CERMET HAVING A BINDER WITH IMPROVED PLASTICITY" by Hans-Wilm Heinrich, Manfred Wolf, Dieter Schmidt, and Uwe Schleinkofer (the applicants of the present patent application) which was filed on the same date as the present patent application and assigned to Kennametal Inc. (the same assignee as the assignee of the present patent application), are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A rotary tool comprising:

an elongate tool body having an axially forward end and an axially rearward end;

a hard insert affixed to the tool body at the axially forward end thereof; and the hard insert comprising a WC-cermet comprising tungsten carbide and about 5 wt. % to 19 wt. % Co—Ni—Fe-binder comprising about 40 wt. % to 90 wt. % cobalt, about 4 wt. % to 36 wt. % nickel, about 4 wt. % to 36 wt. % iron, and a Ni:Fe ratio from about 1.5:1 to 1:1.5.

2. The rotary tool of claim 1 wherein the WC-cermet comprises about 5 wt. % to 15 wt. % binder.

3. The rotary tool of claim 1 wherein the Co—Ni—Fe-binder comprises a face centered cubic (fcc) structure that substantially maintains its fcc structure when subjected to plastic deformation and does not experience stress and strain induced transformations.

4. The rotary tool of claim 1 wherein the Co—Ni—Fe-binder comprises a solid solution face centered cubic alloy.

5. The rotary tool of claim 1 wherein the Co—Ni—Fe-binder comprises about 46 wt. % to 57 wt. % cobalt.

6. The rotary tool of claim 1 wherein the Co—Ni—Fe-binder comprises about 40 wt. % to 90 wt. % cobalt and a Ni:Fe ratio of about 1:1.

7. The rotary tool of claim 3 wherein the Co—Ni—Fe-binder comprises a cobalt:nickel:iron ratio of about 1.8:1:1.

8. The rotary tool of claim 1 wherein the tungsten carbide has a grain size comprising about 1 μm to 30 μm.

9. The rotary tool of claim 1 wherein the tungsten carbide has a grain size comprising about 1 μm to 25 μm.

10. The rotary tool of claim 1 wherein the tungsten carbide has a grain size comprising about 1 μm to 15 μm.

11. The rotary tool of claim 1 wherein the Co—Ni—Fe-binder comprises a face centered cubic (fcc) structure that substantially maintains its fcc structure when subjected to plastic deformation and does not experience stress or strain induced transformations.

12. A hard insert for use in a rotary tool having an elongate tool body with an axially forward end, wherein the hard insert is affixed to the tool body at the axially forward end, the hard insert comprising a WC-cermet comprising tungsten carbide and about 5 wt. % to 19 wt. % Co—Ni—Fe-binder comprising about 40 wt. % to 90 wt. % cobalt, about 4 wt. % to 36 wt. % nickel, about 4 wt. % to 36 wt. % iron, and a Ni:Fe ratio from about 1.5:1 to 1:1.5.

13. The hard insert of claim 12 wherein the WC-cermet comprises about 5 wt. % to 15 wt. % binder.

14. The hard insert of claim 12 wherein the Co—Ni—Fe-binder comprises a face centered cubic (fcc) structure that substantially maintains its fcc structure when subjected to plastic deformation and does not experience stress and strain induced transformations.

15. The hard insert of claim 12 wherein the Co—Ni—Fe-binder comprises a solid solution face centered cubic alloy.

16. The hard insert of claim 12 wherein the Co—Ni—Fe-binder comprises about 46 wt. % to 57 wt. % cobalt.

17. The hard insert of claim 12 wherein the Co—Ni—Fe-binder comprises about 40 wt. % to 90 wt. % cobalt and a Ni:Fe ratio of about 1:1.

18. The hard insert of claim 12 wherein the Co—Ni—Fe-binder comprises a cobalt:nickel:iron ratio of about 1.8:1:1.

19. The hard insert of claim 12 wherein the tungsten carbide has a grain size comprising about 1 μm to 30 μm.

20. The hard insert of claim 12 wherein the tungsten carbide has a grain size comprising about 1 μm to 15 μm.

21. A rotary drilling tool comprising:

an elongate tool body having an axially forward end;

a hard insert affixed to the tool body at the axially forward end thereof; and the hard insert comprising a WC-cermet consisting essentially of about 1 μm to 30 μm tungsten carbide and about 5 wt. % to 19 wt. % solid solution face centered cubic Co—Ni—Fe-binder comprising about 40 wt. % to 90 wt. % cobalt, about 4 wt. % to 36 wt. % nickel, about 4 wt. % to 36 wt. % iron, and a Ni:Fe ratio from about 1.5:1 to 1:1.5, wherein the Co—Ni—Fe-binder substantially maintains its fcc structure when subjected to plastic deformation and does not experience stress or strain induced transformations.

* * * * *